United States Patent [19]

Cornelius et al.

[11] 4,171,069

[45] Oct. 16, 1979

[54] BEVERAGE DISPENSER

[75] Inventors: Richard T. Cornelius, Minnetonka; Charles G. Erickson, Anoka, both of Minn.

[73] Assignee: McQuay-Perfex Inc., Minneapolis, Minn.

[21] Appl. No.: 811,258

[22] Filed: Jun. 29, 1977

[51] Int. Cl.[2] ..... B67D 5/62

[52] U.S. Cl. ..... 222/1; 62/98; 222/146 C

[58] Field of Search ..... 222/146 C, 1, 144.5, 222/400.7, 129.4, 136, 70; 62/399, 98; 138/DIG. 3, DIG. 7, 118; 165/DIG. 8, DIG. 21; 261/DIG. 7

[56] References Cited

U.S. PATENT DOCUMENTS

| | | | |
|---|---|---|---|
| 2,932,323 | 4/1960 | Aries | 138/118 X |
| 3,227,630 | 1/1966 | Beckman | 165/DIG. 8 |
| 3,473,556 | 10/1969 | Johnson et al. | 222/400.7 X |
| 3,746,323 | 7/1973 | Buffington | 261/DIG. 7 X |
| 3,865,276 | 2/1975 | Thompson | 222/146 C |

*Primary Examiner*—John P. Shannon

*Attorney, Agent, or Firm*—Hill, Van Santen, Steadman, Chiara & Simpson

[57] ABSTRACT

A beverage dispenser includes a source of pressurized carbonated beverage which is connected to a dispensing valve by a line extending through a refrigerated bath. In the bath, the line includes a thin-wall high-density polyethylene tubing portion having a wall thickness in the range of 0.018 to 0.028, preferably 0.025 inch, and a density in the range of 0.945 to 0.965, preferably between 0.95 and 0.96.

7 Claims, 2 Drawing Figures

BEVERAGE DISPENSER

BACKGROUND OF THE INVENTION

Field of the Invention

This invention pertains to a method and apparatus for dispensing, and more specifically to a thin-wall high-density polyethylene heat exchanger embodied therein.

SUMMARY OF THE INVENTION

The present invention is directed to a method and apparatus for dispensing a carbonated beverage which includes the use of a thin-wall high-density polyethylene tubing as a heat exchanger for refrigerating pressurized carbonated beverage as it passes therethrough.

Accordingly, it is an object of the present invention to provide a low-cost construction for a beverage dispensing system.

A further object of the present invention is to utilize such a plastic tubing that at operating pressures and temperatures, there will be no appreciable leakage of carbon dioxide gas therethrough.

Many other advantages, features and additional objects of the present invention will become manifest to those versed in the art upon making reference to the detailed description and the accompanying sheet of drawings in which a preferred structural embodiment incorporating the principles of the present invention is shown by way of illustrative example.

ON THE DRAWINGS

Figure 1:
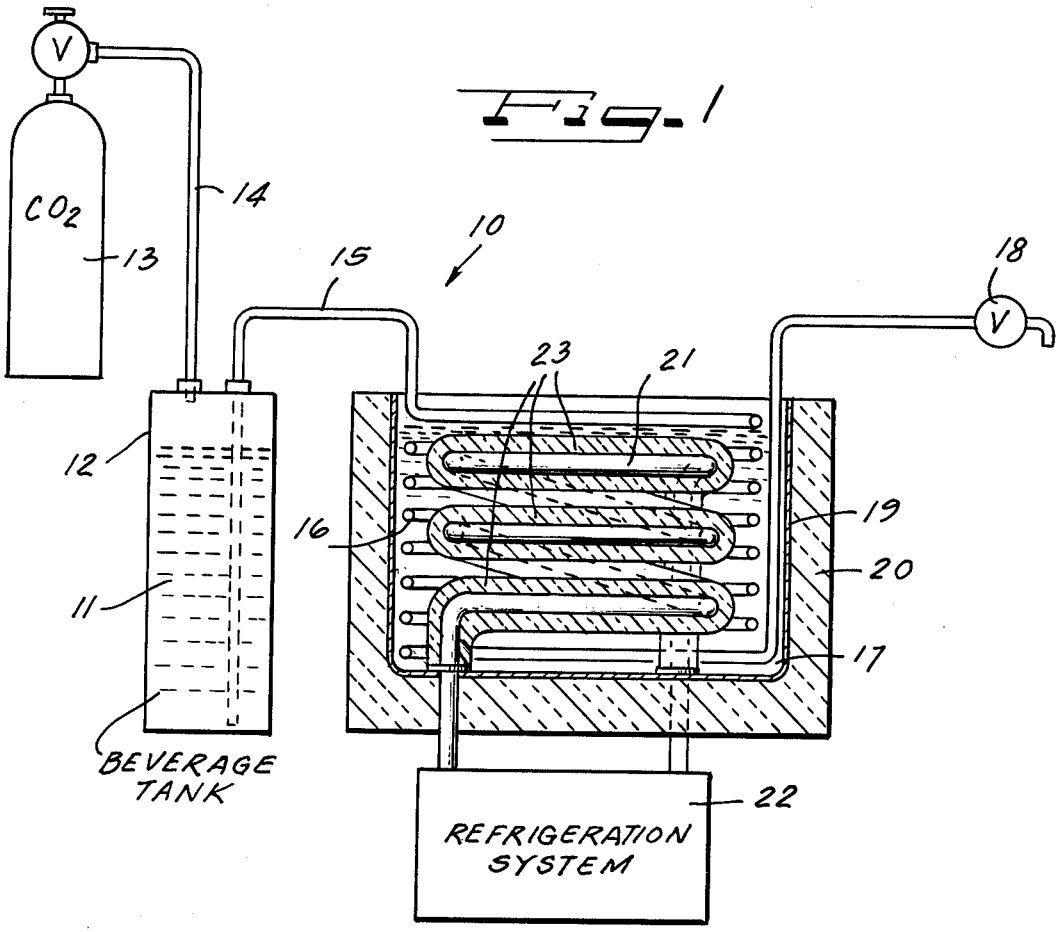
Figure 2:
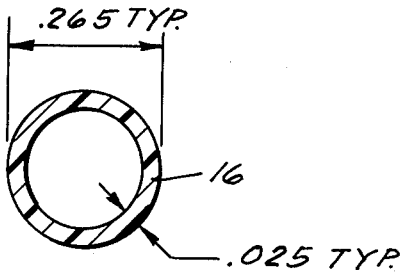

FIG. 1 is a diagrammatic view of a beverage dispensing system and of a method for dispensing a carbonated beverage according to the present invention; and FIG. 2 is an enlarged cross-sectional detail thereof.

AS SHOWN ON THE DRAWINGS

The principles of the present invention are particularly useful when embodied in a method and apparatus for dispensing a carbonated beverage such as illustrated in FIG. 1, generally indicated by the numeral 10.

The system includes a source of pressurized carbonated beverage 11 which here comprises a tank 12 pressurized by a separate source of pressurized carbon dioxide gas 13 through a line 14. If desired, an equivalent source of pressurized carbonated beverage, not shown, would be one wherein compressed air is forced into the tank 12, there being a bladder to separate the air from the carbonated beverage therein. In either event, a pressure of 50 to 60 psi is typically maintained on the source of carbonated beverage 11, a pressure that will ordinarily exceed the partial pressure of the carbon dioxide gas dissolved in the beverage. With a beverage that has 3.5 volumes of $CO_2$ gas dissolved therein, the partial pressure of carbon dioxide gas for the pressure range of 50 to 60 psi will be stable over a temperature range of approximately 74° to 83° F., which in this instance would be the range of ambient temperatures for partial pressures within such pressure range.

The source 11 is connected to a line 15 which has a portion 16 immersed in a refrigerated bath 17 and which is connected to a dispensing valve 18. In this embodiment, the refrigerated bath includes a tank 19 provided with insulation 20 within which there is disposed a refrigeration coil 21 that is connected to a refrigeration system 22, the tank 19 being substantially filled with water so that ice 23 grows on the refrigeration coils 21.

Under a static pressure of 50 to 60 psi, and with cooling typically being to a temperature of 35° F., the partial pressure of the gas dissolved in the beverage will be on the order of 15 psi.

Of all plastics, polyethylene, and in particular high-density polyethylene has the best thermal conductivity, but such conductivity is a function of the density thereof. The material is tasteless, odorless, and thus the portion 16 made of thin-wall high-density polyethylene is capable of conducting a potable beverage such as water, beer or a soft drink therethrough without giving off any taste or odor to the beverage.

It has been found that carbon dioxide gas will pass through a wall of high-density polyethylene and thus such material for the purpose described has heretofore been considered impractical. However, our discovery is that at temperatures just above the freezing point of water, such as in the range 32°–40° F., there is virtually no passage of carbon dioxide gas through the wall. Thus in spite of the fact that it has been believed in the trade that such material cannot be used to conduct a carbonated beverage, our discovery is that it can be so used at temperatures just above freezing without a loss of gas. The magnitude of the fluid pressure does not materially affect the results. It thus appears that while partial pressure of the carbon dioxide gas goes down as a function of temperature, as described above, the permeability of the tubing wall also goes down appreciably.

Thin-wall high-density polyethylene has good strength at low temperatures, and thus the wall thickness can be decreased so as to improve heat transfer. A wall thickness in the range of 0.018 to 0.028 is preferred, and a production run of such tubing would need a typical wall thickness of 0.025 inch, the range of 0.020 to 0.025 inch being a range of wall thicknesses that could be expected in the production of typical 0.025 inch wall thickness tubing. Such tubing would have an outside diameter typically of 0.265 inch.

The term "high-density" as used herein has a typical density range of 0.945 to 0.965, while 0.95 to 0.96 would be the typical range of densities in a production run.

One of the exceptionally dramatic benefits obtained by such usage and construction is that cooling coils heretofore having manufacturing costs on the order of $25.00 can be provided according to this invention at a cost on the order of 25 cents, but up to now, doing so has not been known in the industry.

The thin-wall high-density polyethylene tubing is made by conventional extrusion methods and apparatus, there being a conventional screen in the extruder to prevent any unmelted pellets from getting through into the extrusion.

Although various minor modifications might be suggested by those versed in the art, it should be understood that we wish to embody within the scope of the patent warranted hereon, all such embodiments as reasonably and properly come within the scope of our contribution to the art.

We claim as our invention:

1. In a method for dispensing a beverage, using thin-wall high-density polyethylene tubing immersed in cold water as a heat exchanger for refrigerating a pressurized carbonated beverage as it passes therethrough.

2. A beverage dispensing system, comprising:

(a) a source of pressurized carbonated beverage;

(b) a refrigerated bath;

(c) a disensing valve; and (d) a line connecting said source to said valve and having a thin-wall high-density polyethylene tubing portion disposed in said refrigerated bath for directly engaging water therein.

3. A beverage dispensing system according to claim 2, the wall thickness of said tubing being in the range of 0.018 to 0.028 inch.

4. A beverage dispensing system according to claim 3, said wall thickness being about 0.025 inch.

5. A beverage dispensing system according to claim 2, the density of said tubing being in the range of 0.945 to 0.965.

6. A beverage dispensing system according to claim 5, said density being between 0.95 and 0.96 both inclusive.

7. A beverage dispensing system according to claim 6, the wall thickness of said tubing being about 0.025 inch.

* * * * *